United States Patent [19]

Eto et al.

[11] 4,103,206

[45] Jul. 25, 1978

[54] FLAT TYPE MULTI-DIGIT INDICATING APPARATUS

[75] Inventors: Goro Eto; Chuichi Hikida, both of Mobara, Japan

[73] Assignee: Futaba Denshi Kogyo K. K., Chiba, Japan

[21] Appl. No.: 683,934

[22] Filed: May 6, 1976

[30] Foreign Application Priority Data

May 8, 1975 [JP] Japan ..... 50-61046[U]

[51] Int. Cl.[2] ..... H01J 5/02; H01J 5/20; H01J 63/02

[52] U.S. Cl. ..... 313/513; 313/220; 313/317; 313/497

[58] Field of Search ..... 313/496, 497, 495, 513, 313/519, 522, 317, 220

[56] References Cited

U.S. PATENT DOCUMENTS

| | | | |
|---|---|---|---|
| 2,967,965 | 1/1961 | Schwartz | 313/484 |
| 3,177,345 | 4/1965 | Plumat | 313/220 X |
| 3,327,153 | 6/1967 | Bickmire et al. | 313/517 X |
| 3,327,154 | 6/1967 | Bowerman | 313/519 |
| 3,408,523 | 10/1968 | Demarest et al. | 313/522 |
| 3,743,880 | 7/1973 | Demarest | 313/522 |
| 3,800,178 | 3/1974 | Farina | 313/497 |

*Primary Examiner*—Palmer C. Demeo
*Attorney, Agent, or Firm*—Oblon, Fisher, Spivak, McClelland & Maier

[57] ABSTRACT

An envelope for hermetically containing various functional elements of an indicator tube is disclosed. The envelope includes a base plate and a transparent cover mounted on a front surface of the base plate to form a chamber with the base plate which contains a plurality of the indicator elements. The cover comprises a channel plate having a transparent upper viewing window and side ridges or walls and a pair of strips to be bonded to the open side ends of the channel plate.

6 Claims, 7 Drawing Figures

FLAT TYPE MULTI-DIGIT INDICATING APPARATUS

BACKGROUND OF THE INVENTION

1. Field of the Invention

This invention relates generally to a plane type multi-digit indicating apparatus for use in small electronic appliances such as small electronic calculators, electronic clocks of a digital display type and the like, and more particularly to improvements in envelopes or enclosures for such appliances.

2. Description of the Prior Art

There are various conventional structures for multi-digit indicator tubes for use in electronic calculators or other electronic appliances. It is remarkable that the electronic calculators have recently come into wide use and the popularity of the electronic calculators is still more increasing. The electronic calculators which are now increasing in demand are smaller in size, easy to carry and less expensive. Accordingly, there are great demands for the indicator tubes suitable for use in these electronic calculators.

In order to meet the recent demands for the small-sized electronic calculators, flat-type indicator tubes have been proposed. One of the indicator tubes of this type includes a flat rectangular base plate and a cover plate having a transparent slightly curved front viewing window and a peripheral edge projecting horizontally around the cover plate. The entire configuration of the cover plate is generally a flat-bottomed boat shape, and the cover plate is secured to the base plate at the peripheral edge thereof to thereby form an envelope.

The indicator tube of this type has been widely used, because it is thin and handy. Also, the cover plate is formed into a flat-bottomed boat shape having the slightly curved front surface, which make it possible to form the envelope an appealing streamlined shape. In addition, this type of the indicator tube does not require a spacer which is placed between the base plate and cover plate when these plates are joined together, and the sealing of the base plate and cover plate are relatively easy, because the cover plate is directly secured to the base plate at the peripheral edge thereof.

However, the cover plate according to this type of the indicator tube is usually made of transparent glass, and must be formed in the flat-bottomed boat shape one by one by heat processing so that distortion or shrinkage which is deleterious to observe activated indicator elements within the envelope may not be created on the upper viewing window. Accordingly, the cost of the indicator tube using the cover plate described above becomes high. Also, it is somewhat difficult to fabricate the upper viewing window in a perfect flat condition so as to be easy to observe the indicator elements within the envelope, because melted glass tends to accumulate thickly at the four corners of the cover plate when the cover plate is manufactured. Further, there is a limitation with respect to the width of peripheral edge of the cover plate, even if the size of the indicator tube is reduced. This is considered to be a bottleneck for making the indicator tube compact.

The conventional indicator tube of another type includes a flat rectangular base plate and a flat face plate which is hermetically sealed to the base plate at the peripheral edges thereof by means of a spacer disposed therebetween so that a chamber may be provided between the base plate and the face plate.

The indicator tube of this type has been widely used as well. The face plate used in this indicator tube is prepared by simply cutting a flat glass plate into a rectangular shape which is easily available on the market at low price. Accordingly, the envelope for enclosing the indicator elements can be relatively easy to fabricate. Also, the indicator elements within a casing can be easy to observe, because the flat glass plate is used as the face plate. However, this type of indicator tube must use the spacer, as for example, baked or temporary baked ceramic spacer formed in a shape of hollow frame or a glass spacer formed in a shape of hollow frame by etching a glass plate. Thus, the cost of the spacers is fairly expensive. In addition, the envelope of the indicator tube of this type includes sharp peripheral edges as they cut the glass plate around the base plate and face plate, which makes the outward appearance of the indicator tube unshapely and less appealing. Also, there is a limitation with respect to the thickness of the spacer frame in this type of indicator tube even if it is reduced in size. This is considered to be a problem for making the indicator tube compact.

SUMMARY OF THE INVENTION

Therefore, the present invention contemplates to eliminate the above-mentioned disadvantages of the conventional indicator tube and to provide a new and novel indicator tube.

It is an object of the present invention to provide an indicator tube having a casing or an envelope which is extremely simplified and can be manufactured from materials easily available on the market at low price.

It is another object of the present invention to provide an indicator tube which enables simplified sealing of a base plate and a cover plate to form a casing or an envelope of the indicator tube, thereby to increase the yield in the production process and to produce uniform and high quality product on a mass production basis at low cost.

It is still another object of the present invention to provide an indicator tube having a flat front viewing window which is completely free of deformation or distortion liable to be created during the production process of a cover plate and easy to review indicator elements within a casing.

It is a further object of the present invention to provide an indicator tube which is excellent in appearance, capable of reducing the overall size thereof and suitable for use in small-sized electronic calculator of portable type.

The foregoing and other objects are attained in accordance with one aspect of the present invention through the provision of an indicator tube which comprises a base plate having a plurality of indicia forming means on the upper surface thereof and a cover plate to be hermetically sealed to the base plate to form an envelope. The base plate is prepared by simply cutting a flat glass plate into a rectangular shape which is commercially easily available. The cover plate is also made of a commercially available flat glass plate which is cut in a rectangular shape and the upper and lower longitudinal sides thereof are bent substantially at right angle by heat treatment so as to provide upper and lower peripheral ridges or walls. The resulting configulation of the cover plate is a channel shape. Both the right and left open sides of the cover plate are hermetically sealed with thin strips which may be made of metal, mica, glass, or ceramic.

BRIEF DESCRIPTION OF THE DRAWINGS

Other objects, features and advantages of the present invention will be more apparent from the following description with reference to the accompanying drawings in which like reference characters designate corresponding parts throughout the views in which.

DETAILED DESCRIPTION OF THE PREFERRED EMBODIMENTS

Figure 1:
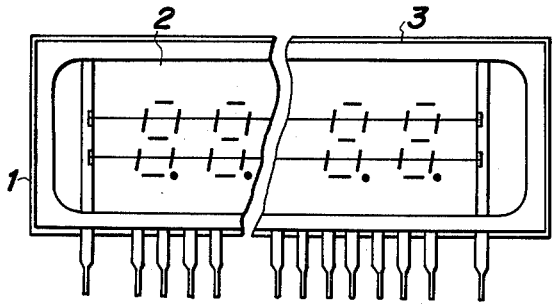
FIG. 1 (PRIOR ART)
FIG. 1 is a partially cutaway plan view of the essential part of a conventional plane type multi-digit indicating apparatus, showing an example thereof.
Figure 2:
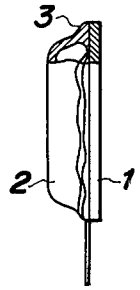
FIG. 2 (PRIOR ART)
FIG. 2 is an end view of FIG. 1 showing a part thereof in section.

Before disclosing the present invention in detail, it will be helpful to describe typical examples of the prior art with reference to FIGS. 1, 2, 3 and 4. In FIGS. 1 and 2, numeral 1 designates a base plate which is a flat rectangular plate of a rigid electrical insulating material, as for example glass or ceramic, on which various functional elements of an indicator tube are formed. A cover plate 2 may be glass or any other transparent or translucent materials which permits observation of the activated functional elements. The cover plate 2 is formed into a flat-bottomed boat shape having slightly curved upper front surface and peripheral edge 3 outwardly projecting around the upper front surface. The base plate 1 and cover plate 2 are joined together in face-to-face relation at the peripheral edge 3 of the cover plate 2 using a sealing medium such as crystalline frit glass.

Figure 3:
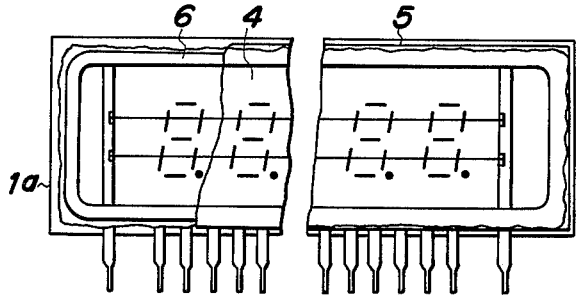
FIG. 3 (PRIOR ART)
FIG. 3 is a partially cutaway plan view of the essential part of a conventional plane multi-digit indicating apparatus, showing another example.
Figure 4:
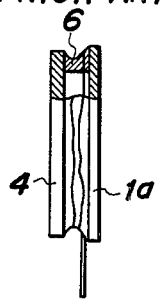
FIG. 4 (PRIOR ART)
FIG. 4 is an end view of FIG. 1 showing a part thereof in section.

The indicator tube shown in FIGS. 3 and 4 includes a base plate 1*a* similar to FIGS. 1 and 2, a flat face plate 4 and a spacer 6. The flat face plate 4 is prepared by simply cutting a commercially available flat glass plate into a rectangular shape substantially in the same dimension as that of the base plate 1*a*. The spacer 6 is fabricated in a shape of hollow frame made of baked or temporary baked ceramic or a glass plate being etched and constitutes a peripheral ridge 5 or wall of the indicator tube. The base plate 1*a* and face plate 4 are bonded together in face-to-face relation using an adhesive agent by placing the spacer 6 therebetween so that a chamber may be provided between the base plate 1*a* and face plate 4 wherein the indicator elements are accomodated.

Figure 6:
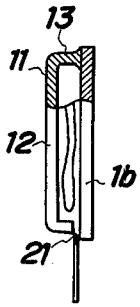
FIG. 6 is an end view of FIG. 5 showing a part thereof in section.
Figure 7:
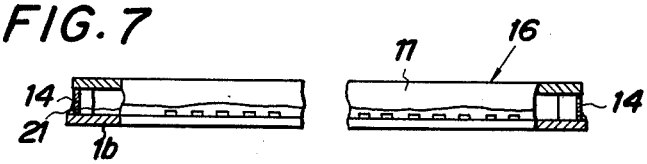
FIG. 7 is a longitudinal end view of FIG. 5 showing parts thereof in section.

Now, the present invention will be hereinafter described in detail with reference to FIGS. 5, 6 and 7.

In the drawings, numeral 1*b* designates a base plate which is a flat rectangular plate of a rigid electrical insulating material, as for example a flat glass plate on the market and includes a plurality of indicia forming means on its front surface. The front surface of the base plate is enclosed with an upper cover generally indicated by the reference numeral 16 which include a channel plate 11 and a pair of side wall plates 14. The channel plate 11 is provided with a viewing window 12 on its front surface and a pair of side walls 13 at the upper and lower sides of the viewing window 12. The viewing window 12 and the side walls 13 are integrally fabricated from a commercially available flat transparent glass plate bending the upper and the lower sides of the glass plate by heat-forming substantially at right angle. The side wall plates 14 constitute remaining right and left side walls of the upper cover 1 and may be made of thin metal or mica strips. The channel plate 11 and a pair of the side wall plate 14 are bonded together so that the upper cover 16 having the viewing window and the peripheral ridge or wall can be formed. The upper cover 16 is then sealed to the base plate 1*b* to form a hermetic and evacuated envelope 15. Numeral 17 designates an exhaust tube for evacuating the envelope 15 which is mounted on a suitable location of the envelope 15 to have it penetrate within the envelope and hermetically sealed by crystalline frit glass.

The indicia forming means disposed on the front surface of the base plate 1*b* include a plurality of anode display portions 18 having fluorescent material layers arranged in a row in spaced side-by-side relation along with the width of the base plate 1*b*, control grids 19 and filament-shaped cathodes 20. A plurality of lead-in wires 22 connected to the anode display portion 18, control grids 19 and cathodes 20, respectively, are led out in an air-tight manner through a sealing portion 21 of the envelope 15. The lead-in wires are connected to an external voltage source through suitable switching circuitry to allow the voltage to be applied to one or more of the various indicia sections as desired.

The joints of the base plate 1*b*, channel plate 11 and side wall plate 14 forming the envelope 15 are hermetically sealed by burning with the use of a suitable bonding material, such as crystalline frit glass for use in sealing. The process for sealing to form the envelope may be conducted by initially joining the channel plate 11 and side wall plates 14 thereby to form the upper cover 16, and then the upper cover 16 and the base plate are joined together, or the channel plate 11, side wall plates 14 and base plate 1*b* may be joined together at the same time.

The channel plate 11 may be fabricated from the same material as the base plate 1*b* such as a flat glass plate usually available on the market. When fabricating the channel plate 11, the glass plate is cut into a dimension including the viewing window and a pair of side wall portions, and then the upper and lower sides of the glass plate are bent by heat-forming thereby to form the side walls 13. Thus, the channel plate 11 as desired can be easily obtained. In this instance, the glass plate is heat-treated just to bend the upper and lower side thereof, thus the viewing window 12 is completely free of deformation or distortion obstructing observation of the indicia through the viewing window 12. During the process of heat-forming of the glass plate to obtain the channel plate 11, the rugged end surfaces of the channel plate 11 as they cut the glass plate are made by firing so as not to be hazardous for handling and round corners along the upper and lower side of the viewing window 12 are formed.

Figure 5:
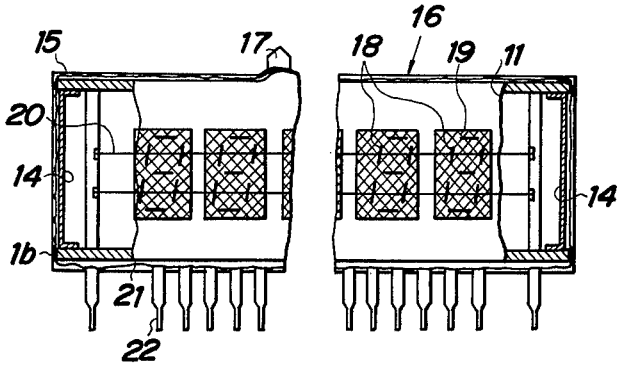
FIG. 5 is a partially cutaway plan view of the essential part of a plane type multi-digit indicating apparatus according to the present invention.

In FIG. 5, channel-shaped side wall plates 14 are illustrated by way of an example, which are inlaid between sthe side walls 13 of the channel plate 11 within the envelope 15. It should be understood that the side wall plates 14 are not intended to limit to this particular shape and various modifications and variations can be considered. For example, rectangular strips may be bonded to the end surfaces of the channel plate 11. The material used for the strip of the side wall plates 14 is preferably a metal adapted for sealing, which has almost the same thermal expansion characteristic as that of the flat glass plate used for the base plate 1*b* and the channel plate 11, such as Fe-Ni-Cr alloy (generally referred to as 42-6 alloy) or Fe-Ni alloy (generally referred to as 50 alloy). The thickness of the metal strip used for the side wall plate 14 may be determined at will, however, the metal strip having a thickness of from 0.05 to 0.5 mm, more and specifically from 0.1 to 0.25 mm is preferable in view of its strength and the convenience of fabrication. The side wall plate 14 may, of course, be made of thin glass, ceramic or mica plate other than the metal plate.

In the above embodiment of the present invention, a fluorescent indicator tube has been illustrated, wherein a plurality of lead-in wires connected to each of electrodes of the indicia forming means within the envelope, are all led out through the sealing portion between the base plate and the upper cover. However, it should be understood that the present invention is not intended to limit this type of indicator tube but can, of course, be applied to other types of indicator tube such as a glow discharge indicator tube, or an indicator tube wherein lead-in wires connected to indicia forming means within a casing are printed on a base plate which has an edge extended beyond an envelope and led outside of the envelope to the extended edge of the base plate where a printed circuit board connector may be plugged in the lead-in wires.

Obviously, numerous modifications and variations of the present invention are possible in light of the above teachings. It is to be understood therefore that within the scope of the appended claims, the invention may be practiced otherwise than as specifically described herein.

What is claimed as new and desired to be secured by Letters Patent of the United States is:

1. A flat type multi-digit indicating apparatus comprising:

a base plate on which a plurality of indicia forming means are arranged in a row in spaced side-by-side relation along the width of said base plate, means for applying voltage to said indicia forming means for effecting multi-digit indication;

a channel plate having a flat transparent upper viewing window and a pair of side walls provided in face-to-face relation along upper and lower side lengths of said viewing window, said viewing window and said side walls being integrally formed, said channel plate being provided with open side ends, a pair of strips for blocking the open side ends of said channel plate, each said strip being formed in a flattened U-shape and inlaid between said side walls of said channel plate wherein the legs of each of said U-shape strips ared connected to said side walls.

said channel plate and said strips being bonded together thereby to form a cover having said upper viewing window and said side walls, and said cover mounted on a front surface of said base plate and forming an hermetically sealed chamber with said base plate which contains said indicia forming means.

2. A flat type multi-digit indicating apparatus as in claim 1, wherein said strips are made of a metal plate having substantially the same thermal expansion characteristics as that of said base plate and said channel plate.

3. A flat type multi-digit indicating apparatus as in claim 1, wherein said strips have thickness from 0.05 to 0.5 mm.

4. A flat type multi-digit indicating apparatus as in claim 1, wherein said strips are made of glass plate.

5. A flat type multi-digit indicating apparatus as in claim 1, wherein said strips are made of ceramic plate.

6. A flat type multi-digit indicating apparatus as in claim 1, wherein said strips are made of mica plate.

* * * * *